US008584974B2

(12) United States Patent
Masloff et al.

(10) Patent No.: US 8,584,974 B2
(45) Date of Patent: Nov. 19, 2013

(54) ROCK DUSTING APPARATUS

(75) Inventors: Brian Peter Masloff, Westminster, CO (US); James Edward Pinkley, Aurora, CO (US); Billy J. Brown, Shady Valley, TN (US); Steven J. Thorogood, Bristol, TN (US); John C. Fodor, Arvada, CO (US)

(73) Assignee: DSI Underground Systems, Inc, Martinsburg, WV (US)

( * ) Notice: Subject to any disclaimer, the term of this patent is extended or adjusted under 35 U.S.C. 154(b) by 48 days.

(21) Appl. No.: 13/209,004

(22) Filed: Aug. 12, 2011

(65) Prior Publication Data

US 2012/0256020 A1 Oct. 11, 2012

Related U.S. Application Data

(60) Provisional application No. 61/472,792, filed on Apr. 7, 2011.

(51) Int. Cl.

| | |
|---|---|
| ***A01C 3/06*** | (2006.01) |
| ***A01C 15/04*** | (2006.01) |
| ***B05B 9/06*** | (2006.01) |
| ***B05B 9/00*** | (2006.01) |
| ***B65G 53/40*** | (2006.01) |

(52) U.S. Cl.
USPC ..... 239/654; 239/77; 239/126; 239/127; 406/154

(58) Field of Classification Search
USPC ..... 239/124, 126, 127.654, 142–144, 336, 239/601, 589
See application file for complete search history.

(56) References Cited

U.S. PATENT DOCUMENTS

| | | | | | |
|---|---|---|---|---|---|
| 1,578,628 | A | * | 3/1926 | Beatty | 169/64 |
| 1,764,113 | A | * | 6/1930 | Miller | 169/64 |
| 1,862,396 | A | * | 6/1932 | Gray et al. | 239/654 |
| 2,521,888 | A | * | 9/1950 | Wilson | 239/654 |
| 2,759,293 | A | * | 8/1956 | Weller | 406/42 |
| 3,039,827 | A | * | 6/1962 | Poundstone et al. | 406/109 |
| 3,194,443 | A | * | 7/1965 | Gurney | 239/654 |
| 3,333,896 | A | * | 8/1967 | Diamanti | 299/12 |

(Continued)

OTHER PUBLICATIONS

International Search Report and Written Opinion dated Jan. 12, 2012 corresponding to International Patent Application PCT/US2011/047601.

*Primary Examiner* — Len Tran
*Assistant Examiner* — Alexander M Valvis
(74) *Attorney, Agent, or Firm* — Ohlandt, Greeley, Ruggiero & Perle, L.L.P.

(57) ABSTRACT

A rock dusting apparatus comprising: a housing; a tank mounted within the housing which comprises a removable top wall member, a sidewall member and a bottom wall member configured to form an internal tank compartment for holding and mixing a rock dust composition; a mixer positioned on the bottom wall member for mixing the rock dust composition; a tank discharge port positioned on the bottom wall member or a lower portion of the sidewall member through which the rock dust composition can be discharged from the tank; a conduit extending from the tank discharge port to a housing discharge port; the conduit comprising a pump for transporting the rock dust composition through the conduit and through a discharge line operatively connected to the housing discharge port; and one or more motors mounted within the housing for powering the mixer and the pump. The apparatus is useful for spraying rock dust compositions for suppressing propagation of a flame and/or fire caused by ignition of coal dust and/or gas within a coal mine.

17 Claims, 10 Drawing Sheets

(56) References Cited

U.S. PATENT DOCUMENTS

| | | | | | |
|---|---|---|---|---|---|
| 3,622,130 | A | * | 11/1971 | Malm | 366/4 |
| 4,155,508 | A | * | 5/1979 | Fiorentini | 239/118 |
| 4,348,057 | A | * | 9/1982 | Parenti et al. | 299/12 |
| 4,394,975 | A | * | 7/1983 | Bare et al. | 239/654 |
| 4,401,468 | A | * | 8/1983 | Henderson | 423/30 |
| 4,510,883 | A | | 4/1985 | Estes | 118/305 |
| 4,538,941 | A | * | 9/1985 | Thorne | 406/143 |
| 4,673,131 | A | * | 6/1987 | Travis | 239/673 |
| 4,805,702 | A | * | 2/1989 | White | 169/64 |
| 4,872,598 | A | | 10/1989 | Travis | 222/630 |
| 5,025,287 | A | * | 6/1991 | Hilbert | 399/254 |
| 5,165,958 | A | | 11/1992 | Plaisted et al. | |
| 5,190,416 | A | | 3/1993 | Nakagawa | |
| 5,854,311 | A | * | 12/1998 | Richart | 523/309 |
| 6,053,365 | A | * | 4/2000 | O'Mara et al. | 222/148 |
| 6,135,368 | A | * | 10/2000 | Protan | 239/654 |
| 6,250,224 | B1 | * | 6/2001 | Hofmann et al. | 101/424.2 |
| 6,481,990 | B2 | | 11/2002 | Wong et al. | 418/82 |
| 6,726,849 | B2 | | 4/2004 | Gay et al. | |
| 7,048,340 | B2 | * | 5/2006 | Lammer et al. | 299/12 |
| 7,854,402 | B1 | * | 12/2010 | Travis | 239/673 |
| 8,308,394 | B2 | * | 11/2012 | Whitley | 404/75 |
| 2010/0288858 | A1 | | 11/2010 | Redman | 239/654 |
| 2011/0180152 | A1 | * | 7/2011 | Dorsch | 137/15.05 |

* cited by examiner

ROCK DUSTING APPARATUS

RELATED APPLICATIONS

This application claims the benefit of U.S. Provisional Application Ser. No. 61/472,792, filed on Apr. 7, 2011, which is incorporated herein by reference.

BACKGROUND

1. Field of the Disclosure

This disclosure relates to a rock dusting apparatus for distributing rock dust, aggregate or other materials. This disclosure relates to an apparatus and method for distributing rock dust particularly for use in the underground coal mining industry. However, the apparatus can be used to distribute other materials.

2. Discussion of the Background Art

It is well known that fires and explosions are a major hazard in the field of underground mining. The danger of fire and explosion is particularly acute in coal mining because of the existence of inherently explosive and flammable materials, such as methane gas and coal dust, in the underground coal mine.

The cause of such fires and explosions can be readily appreciated. Combustible materials are generally associated with the mining of materials, such as coal, which are based on organic chemicals. Not only is the coal itself combustible, but the mining operation produces small fragments of coal and coal dust which are introduced into the air. This material may well be combustible and even explosive under appropriate conditions.

Hydrocarbon gases are found in association with coal mine operations. The most commonly found gas is methane gas, the major component of natural gas. Other similar combustible hydrocarbon gases are also found in lesser quantities in association with coal mines. The gaseous materials which are released during coal mine operations are themselves extremely hazardous.

Coal mine operations can often result in sufficient sparks to ignite combustible and explosive materials. Coal mine operations require the use of many types of electrical apparatus as well as other types of machinery which can potentially produce sparks. The combination of spark-producing machinery and electrical equipment, and the extremely explosive and combustible coal dust and related gases, produces a hazardous situation.

The combination of potentially spark producing equipment and extremely combustible material found within underground mines has resulted in disaster on many occasions. In addition, underground explosions and fires are particularly difficult to survive. For example, the explosion may cause collapse of part of the mine tunnel. Fire and explosion underground produces large quantities of noxious gases which can easily produce personal injury or death to underground miners and others working underground. Thus, it can be seen that fires and explosions in underground mine operations are of particular concern to all involved.

Various solutions have been attempted in order to prevent fire and explosion in underground mine operations. A conventional method of minimizing the potential for fire and explosion has been to spread inert material within the interior of the mine. In some cases it is desirable to totally coat the interior walls, ceiling and floor of the mine tunnels. Adding inert material to the environment helps to maintain the ambient atmosphere within the mine at conditions which are not explosive or combustible. The inert materials spread onto the interior walls of the mine sufficiently dilute the mine dust and methane within the mine such that the atmosphere is not capable of propagating an explosion or fire. The coating also helps prevent further coal dust and the like from escaping into the air within the mine tunnel.

Dusting as a method of preventing explosions and fires within a mine has become accepted in the art. Under regulations promulgated pursuant to the Federal Coal Mine Health and Safety Act, dusting is now a requirement in many mines.

Regulations of the Mine Safety and Health Administration ("MSHA") provide that the interior of coal mines and the like should be coated with a coating of rock dust. MSHA sets forth regulations concerning the use and spreading of rock dust.

Extensive governmental regulations governing the use and administration of rock dust are now in place. The situations in which rock dust is required are also defined in detail by specific regulation. Thus, mine operators now find themselves in the position of being required to comply with extensive regulation regarding rock dusting. Rock dusting within coal mines, therefore, is often no longer just one alternative to dealing with potentially hazardous conditions, but rather, is absolutely required in many settings.

As indicated above, in underground coal mines, stone dusting of exposed rock surfaces is used to prevent and suppress fires caused by the ignition of coal dust and methane gas produced during the mining process. Stone dusting involves coating the surfaces of the mine with a fine-ground limestone dust. The dust adheres to the walls of the mine and prevents propagation of fires along exposed surfaces of unmined coal in the mine. In the event of the ignition of coal dust and gas within the mine, the concussion of an explosion and fire will cause the loosely adhering dust to fall from the surfaces of the mine to produce a limestone dust-air suspension that suppresses the propagation of flame and stops the fire.

Applying rock dust to mine walls is usually accomplished with the use of rock dusting machines. These machines, however, generally require continuous attention by one or more operators as well as a large amount of maintenance, distribute large quantities of rock dust indiscriminatingly and therefore inefficiently, or require the use of other underground mining equipment thereby interfering with production schedules. Additionally, the machines are not easily transportable.

Further, some of these machines use highly pressurized air which may lead to unsafe conditions. As such, the tanks containing this highly pressurized air require pressure relief valves to prevent failure of the tank due to the highly pressurized air. These additional mechanical parts add to the cost and maintenance requirements of the machine.

These machines generally fall into two categories. First, there are those machines which use complex mechanisms with numerous moving parts to transport the rock dust through the machine and to then distribute the rock dust into the mine entry thereby causing wear on the parts which come in contact with the rock dust. Second, there are those machines which rely upon a combination of gravity and pressure differentials, known in the art as venture effect, to move and distribute the rock dust. The machines which use gravity and pressure differentials generally use small tubes or orifices through which the rock dust must pass and are therefore susceptible to the bridging of the rock dust or otherwise clogging, especially if the rock, dust has become wet or otherwise absorbed any moisture, thereby preventing the rock dust from being distributed as required.

There is a need in the art for a simple rock dusting apparatus which requires little operator attention, which does not interfere with production schedules, and which can provide the continuous and controllable distribution of rock dust as needed. There also exists a need for an improved rock dusting apparatus that solves the maintenance and portability problems.

The present disclosure provides many advantages, which shall become apparent as described below.

SUMMARY

A rock dusting apparatus comprising:

a housing;

a tank mounted within the housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of the sidewall member through which the rock dust composition can be discharged from the tank;

a conduit extending from the tank discharge port to a housing discharge port; the conduit comprising a pump for transporting the rock dust composition through the conduit and through a discharge line operatively connected to the housing discharge port; and one or more motors mounted within the housing for powering the mixer and the pump.

This disclosure relates in part to a rock dusting apparatus comprising:

a housing;

a tank mounted within the housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of the sidewall member through which the rock dust composition can be discharged from the tank;

a conduit extending from the tank discharge port to a housing discharge port positioned on the housing; the conduit comprising a pump for transporting the rock dust composition through the conduit;

an air supply unit mounted within the housing operatively connected to the discharge line adjacent to the housing discharge port to inject air for aiding transport of the rock dust composition through a discharge line, the discharge line operatively connected to the housing discharge port; and one or more motors mounted within the housing for powering the mixer, the pump, and the air supply unit.

This disclosure also relates in part to a process for forming a composition on a surface, the process comprising:

a) providing a rock dusting apparatus;

b) mixing rock dust and water in the rock dusting apparatus to give a first mixture;

c) adding a pumping aid to the first mixture to give a second mixture;

d) blending a polymer into the second mixture to give a third mixture;

e) mixing with agitation the third mixture to give a foamed or aerated composition;

f) applying the foamed or aerated composition to the surface using the rock dusting apparatus; and g) allowing the foamed or aerated composition to dry to form the composition on the surface;

wherein the rock dusting apparatus comprises:

a housing;

a tank mounted within the housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of the sidewall member through which the rock dust composition can be discharged from the tank;

a conduit extending from the tank discharge port to a housing discharge port; the conduit comprising a pump for transporting the rock dust composition through the conduit and through a discharge line operatively connected to the housing discharge port; and one or more motors mounted within the housing for powering the mixer and the pump.

This disclosure further relates in part to a process for forming a composition on a surface, the process comprising:

a) providing a rock dusting apparatus;

b) mixing rock dust and water in the rock dusting apparatus to give a first mixture;

c) mixing a pumping aid and a polymer in a container to give a second mixture;

d) adding the second mixture to the first mixture to give a third mixture;

e) mixing with agitation the third mixture to give a foamed or aerated composition;

f) applying the foamed or aerated composition to the surface using the rock dusting apparatus; and g) allowing the foamed or aerated composition to dry to form the composition on the surface;

wherein the rock dusting apparatus comprises:

a housing;

a tank mounted within the housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of the sidewall member through which the rock dust composition can be discharged from the tank;

a conduit extending from the tank discharge port to a housing discharge port; the conduit comprising a pump for transporting the rock dust composition through the conduit and through a discharge line operatively connected to the housing discharge port; and one or more motors mounted within the housing for powering the mixer and the pump.

This disclosure yet further relates in part to a method of dusting coal mine surfaces, the method comprising:

a) providing a rock dusting apparatus;

b) providing a composition comprising rock dust, water, a pumping aid, and a polymer;

c) mixing with agitation the composition in the rock dusting apparatus to give a foamed or aerated composition;

d) applying the foamed or aerated composition to a coal mine surface using the rock dusting apparatus; and e) allowing the foamed or aerated composition to dry on the coal mine surface;

wherein the rock dusting apparatus comprises:

a housing;

a tank mounted within the housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of the sidewall member through which the rock dust composition can be discharged from the tank;

a conduit extending from the tank discharge port to a housing discharge port; the conduit comprising a pump for transporting the rock dust composition through the conduit and through a discharge line operatively connected to the housing discharge port; and one or more motors mounted within the housing for powering the mixer and the pump.

This disclosure also relates in part to a method for suppressing propagation of a flame and/or fire caused by ignition of coal dust and/or gas within a coal mine, the method comprising:

a) providing a rock dusting apparatus;

b) providing a composition comprising rock dust, water, a pumping aid, and a polymer;

c) mixing with agitation the composition in the rock dusting apparatus to give a foamed or aerated composition;

d) applying the foamed or aerated composition to a coal mine surface using the rock dusting apparatus; and e) allowing the foamed or aerated composition to dry on the coal mine surface;

wherein the foamed or aerated composition dried on the coal mine surface has sufficient adherence to the coal mine surface that, upon ignition of coal dust and/or gas within the coal mine, a concussion from an explosion and/or fire causes at least a portion of the rock dust to detach from the coal mine surface to produce a rock dust-air suspension that suppresses propagation of a flame and/or fire in the coal mine;

wherein the rock dusting apparatus comprises:

a housing;

a tank mounted within the housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of the sidewall member through which the rock dust composition can be discharged from the tank;

a conduit extending from the tank discharge port to a housing discharge port; the conduit comprising a pump for transporting the rock dust composition through the conduit and through a discharge line operatively connected to the housing discharge port; and one or more motors mounted within the housing for powering the mixer and the pump.

An advantage of this disclosure is that the rock dusting apparatus does not employ complex mechanisms with numerous moving parts to transport the rock dust through the machine, thereby minimizing wear on the parts which come in contact with the rock dust. The rock dusting apparatus of this disclosure does not use small tubes or orifices through which the rock dust must pass, therefore minimizing susceptibility to bridging of the rock dust or otherwise clogging which would prevent the rock dust from being distributed as required. The rock dusting apparatus of this disclosure requires little operator attention, does not interfere with production schedules, and provides the continuous and controllable distribution of rock dust as needed. The rock dusting apparatus also requires little maintenance and is portable. The rock dust composition applied on the coal mine surface by the rock dusting apparatus has sufficient adherence to the coal mine surface that, upon ignition of coal dust and/or gas within a coal mine, a concussion from an explosion and/or fire causes at least a portion of the rock dust particles to detach from the polymer chains to produce a rock dust-air suspension. The rock dust-air suspension suppresses propagation of a flame and/or fire caused by ignition of coal dust and/or gas within the coal mine.

Further objects, features and advantages of the present disclosure will be understood by reference to the following drawings and detailed description.

DETAILED DESCRIPTION OF THE PREFERRED EMBODIMENT

Figure 1:
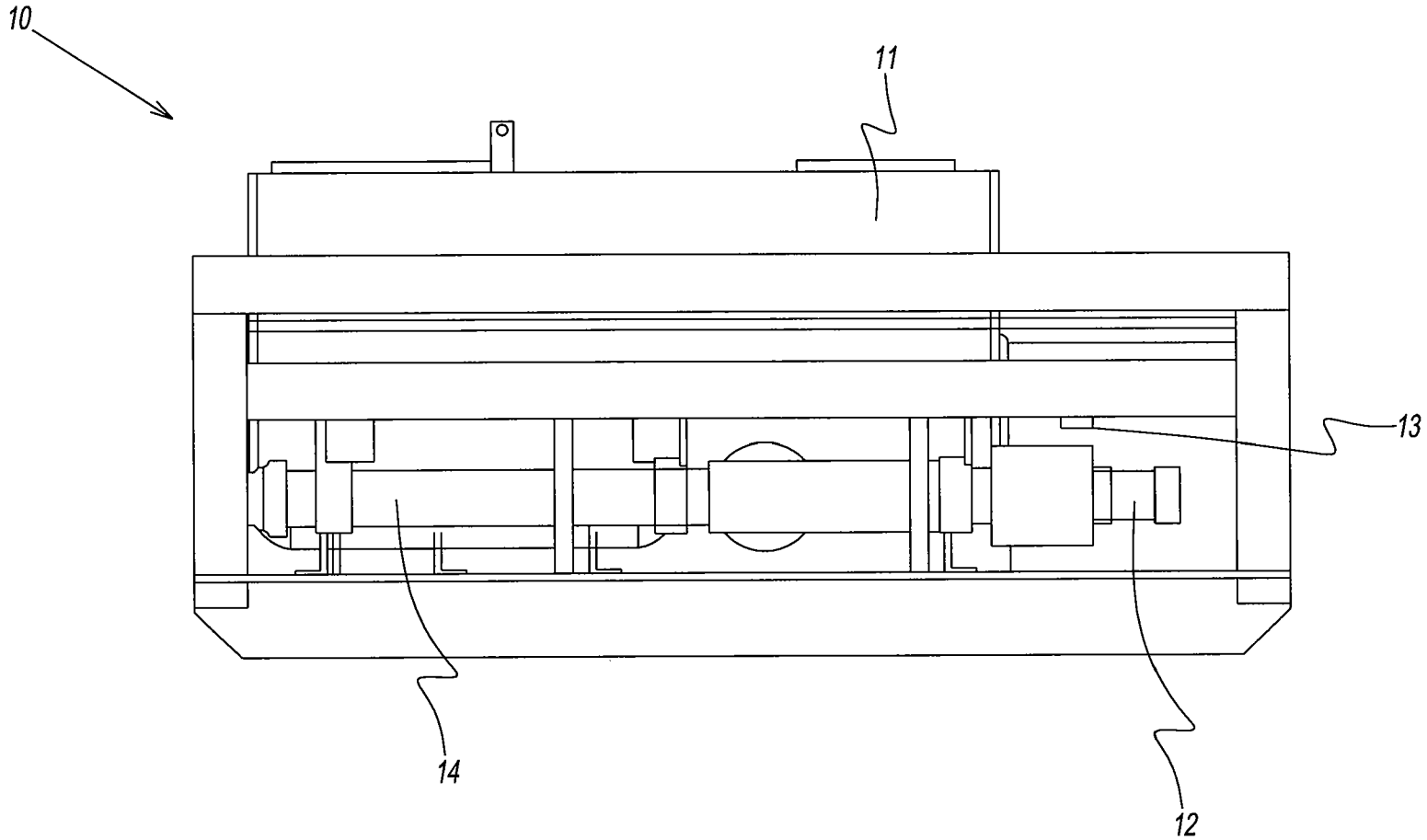
FIG. 1 depicts a right side view from the front of the rock dusting apparatus of this disclosure.
Figure 2:
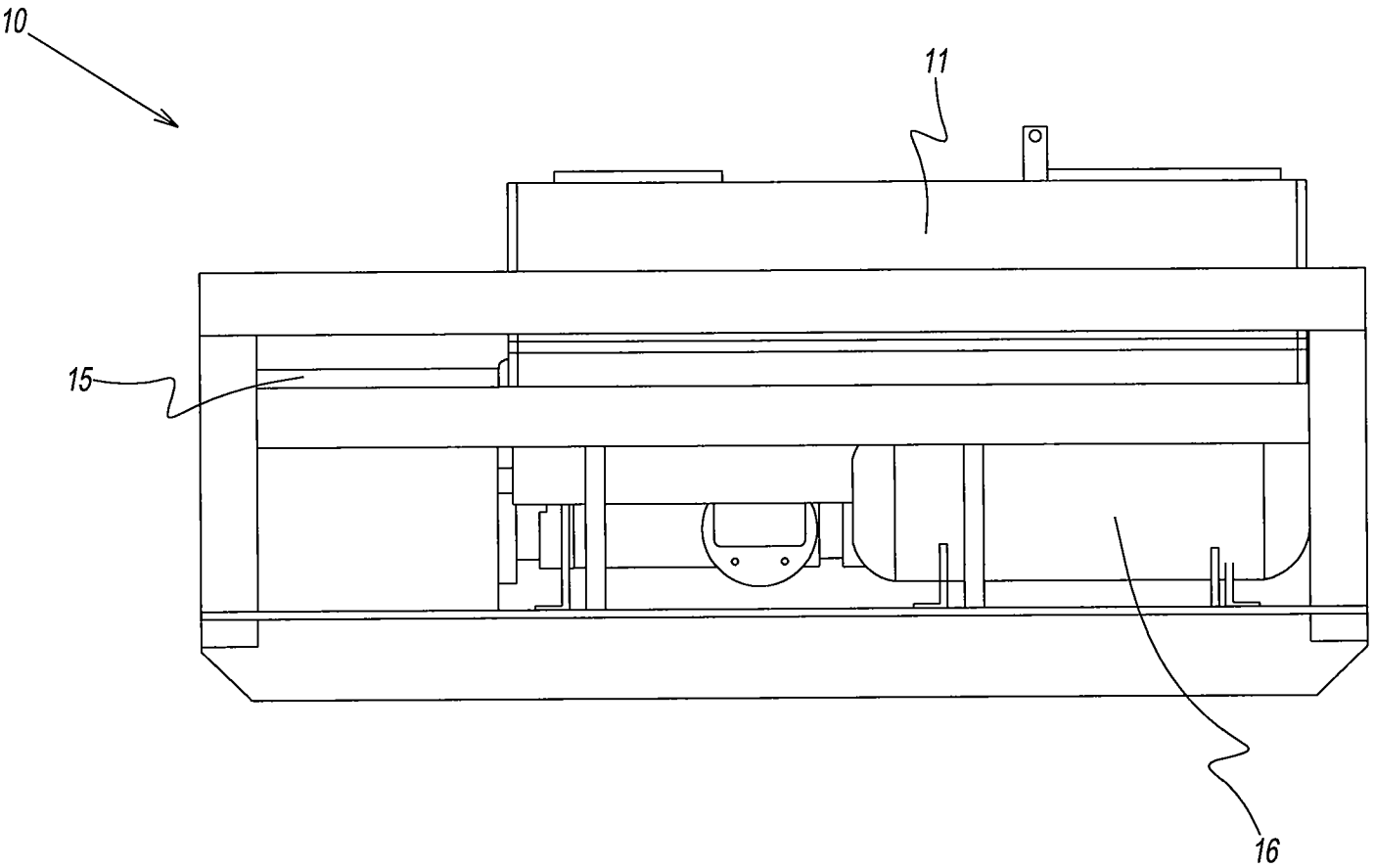
FIG. 2 depicts a left side view from the front of the rock dusting apparatus of this disclosure.
Figure 3:
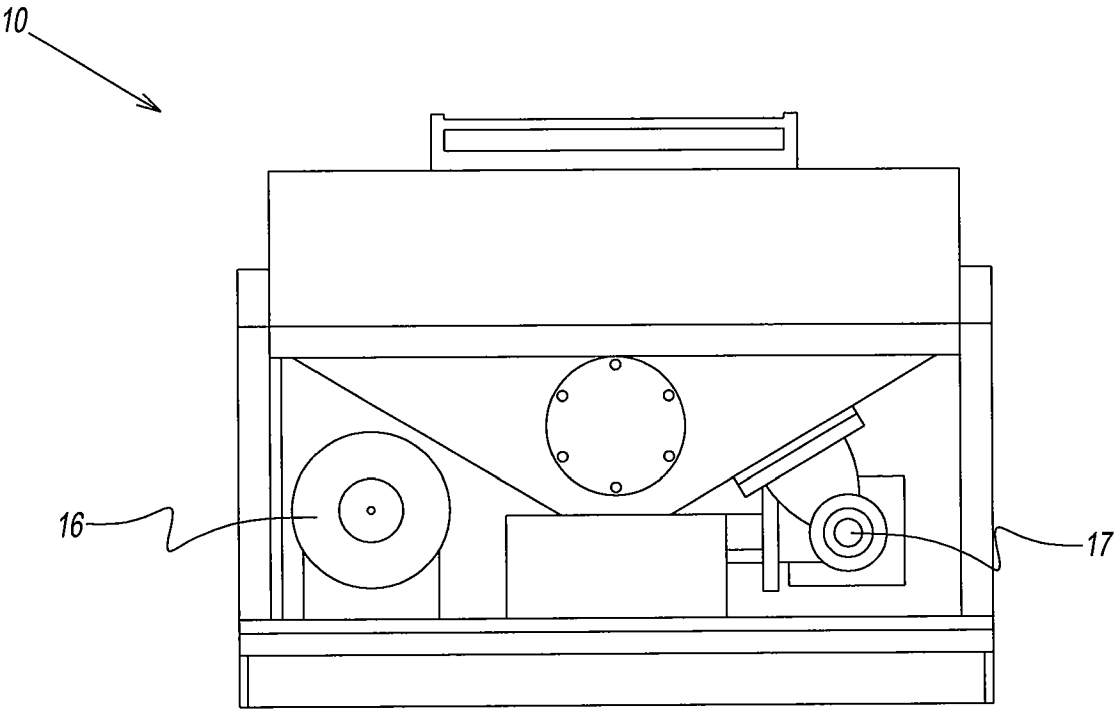
FIG. 3 depicts a front view of the rock dusting apparatus of this disclosure.
Figure 4:
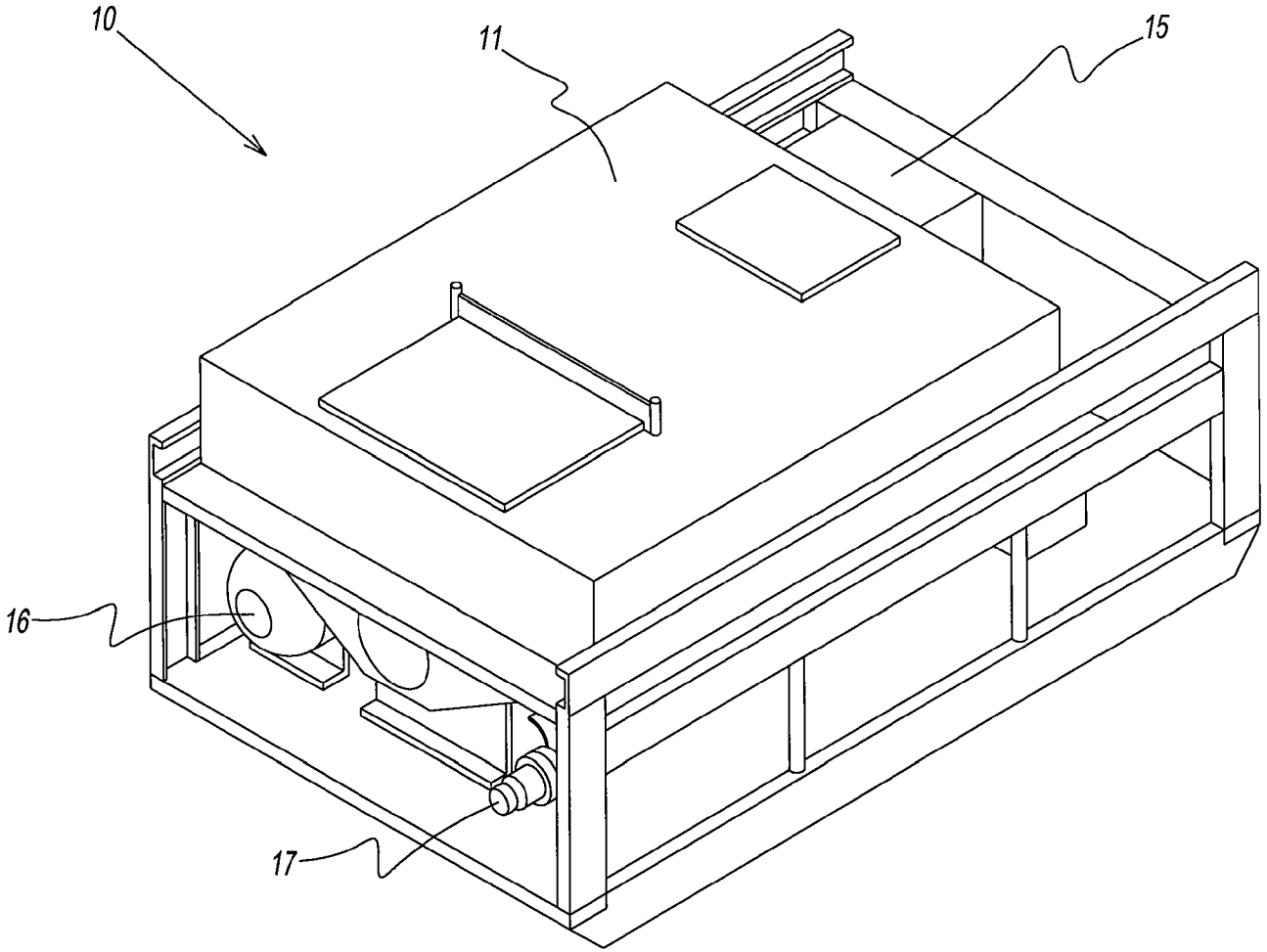
FIG. 4 depicts the apparatus of this disclosure.

This disclosure provides a rock dusting apparatus for dusting mine surfaces to prevent and suppress fires and explosions.

The rock dusting apparatus of this disclosure is a portable unit. The apparatus can be completely powered by hydraulics. The apparatus has the ability to operate at from about 12 gpm to about 35 gpm hydraulic range with full adjustability of hydraulic functions, e.g., pumping, mixing and air transport, to mate hydraulic functions with desired product attributes.

The rock dusting apparatus of this disclosure can be operated by two mine personnel. One scoop operator can run the mobile scoop equipment for hydraulic power, and one miner can operate the apparatus hydraulic valve bank, spray gate valves and spray nozzle for final product placement in the mine.

The rock dust composition pumping in the apparatus can be conducted at low pressures, preferably pumping cycles from about 40 psi to about 80 psi. A recycle circuit in the apparatus contributes to the lower operating pressure of from about 40 psi to about 80 psi, so that the final product has less compression due to high pressure during final placement. This provides improved drying attributes of the final product.

The rock dusting apparatus of this disclosure can have a hydraulic air compressor mounted therein to provide up to about 125 psi of compressed air for aiding transportation of the rock dust composition through the discharge line, e.g., hose. This allows for final dispersion and placement at low pressures of the rock dust composition onto the mine surfaces e.g., roof and ribs. The air also allows for about 30 percent to about 50 percent more yield of the rock dust composition during spraying operations, thereby creating cost effectiveness as well as improved drying attributes of the final product.

The hydraulic air compressor has a check valve on a return line to the multi-spool valve bank and a check valve on a return PTO line, to eliminate return line overpressure.

The discharge line, e.g., hose, has a diameter of from about ¾ inch to about 1¼ inch that allows for lower operating pressure of the pump, progressive cavity pump. This allows for reduced compression pressures on the rock dust composition batch product and for improved drying attributes of the final product.

A high impact flat deflected spray nozzle is attached to the discharge line that enables proper application of the rock dust composition final product to the mine surfaces, e.g., roof and ribs. The nozzle allows for lower operating pressures in the pump, e.g., progressive cavity pump, and a reduction of compression pressures on the rock dust composition batch product. The nozzle also allows for improved dispersion and drying attributes of the final product.

The applicator apparatus can be a completely hydraulic powered unit that can be powered by a battery or diesel scoop power takeoff (PTO) hydraulic circuit. The apparatus includes hose, e.g., 50 feet, and nozzle operation by the end user spray operator, who is supported by a scoop operator to function the unit. The applicator apparatus allows for batching of product and face spraying operations in permissible locations. A typical batch operation allows for 200 feet of rib and roof coverage of rock dust application depending on the height and width of the mine.

The apparatus of this disclosure allows the rock dust composition to be prepared at an underground station in the mine. To form the composition, the mixture of rock dust and water can be blended in the mixing tank mounted in the apparatus. At the bottom of the mixing tank can be a paddle mixer or segmented auger screw that provides the mixing action needed to blend the ingredients. A paddle mixer can preferably be used to blend the ingredients into a homogeneous composition. This mixing vessel can also be used to blend the pumping aid and polymer, or, alternatively, the pumping aid and polymer can be injected directly into the grout stream after the pump for mixing.

The apparatus can be moved underground and positioned to any accessible area in the mine where the dusting activity may be required. Once at the position for application in the mine, a pump operatively connected to the mixing tank can be used to pump the composition through a hose and nozzle where it is applied to the surfaces, e.g., walls, ceilings and floors, of the mine. Some of the composition may be lost on impact with the mine surfaces if blended in the mixing vessel. If the polymer is injected into the grout stream no loss will occur. The low water content of the rock dust compositions useful herein promotes rheological stiffening, making the mass sticky, and promoting adhesion to the surface and allowing build-up of the material to a desired thickness. The velocity of the composition sprayed from the nozzle should allow the retention of the composition on the surfaces and retain the properties needed for the performance of the composition in the event of an explosion and mine fire.

In addition, if the composition is to be applied in more than one place, the material can be fabricated at a first location and pumped to stations within the mine. There, the material could be retained for use as needed without having to transport the material in large tanks for long distances throughout the mine.

For example, the composition can be applied by a continuous cavity pump, to pump the composition to a pneumatic application nozzle. The use of this nozzle allows adequate application of composition onto the mine surface. The composition can additionally be applied using an airless system. The simplest form of an airless system can be the elimination of the nozzle and reliance only on the pressure produced by a continuous cavity pump to apply the material.

Figure 10:
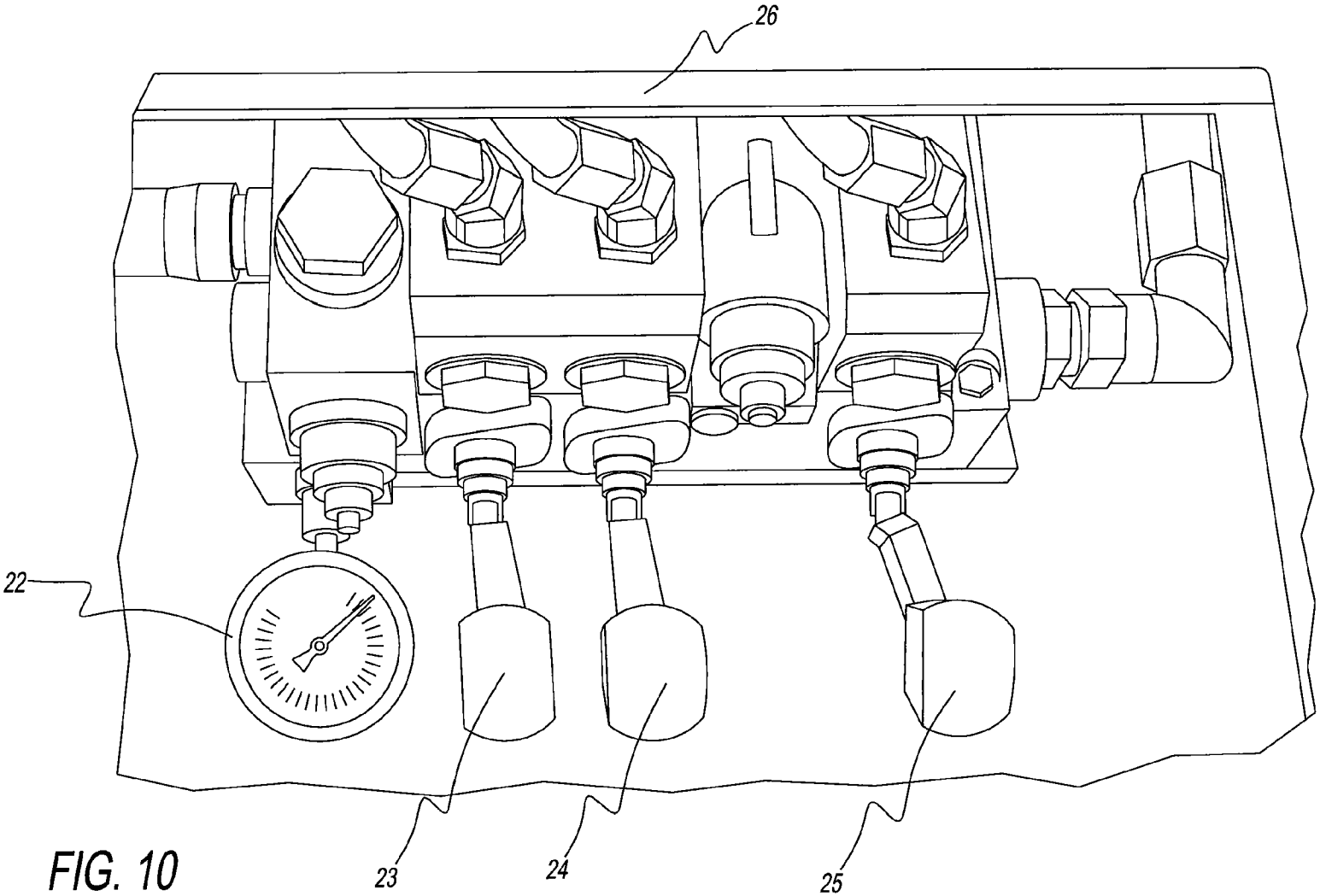
FIG. 10 depicts the three spool valve bank used in the apparatus of this disclosure.

The operation of the apparatus is simplified for mine personnel. Full hydraulic adjustability is possible with the apparatus to allow the apparatus to be utilized by various mine utility equipment and scoops. Referring to FIG. 10 and also FIGS. 1-4, the apparatus includes a manually operated multi-spool valve bank 26. The manually operated multi-spool valve bank 26 includes a pump/spray lever 23, a mixing lever 24, and an air compressor lever 25. The manually operated multi-spool valve bank 26 further includes an air compressor gauge 22.

The manually operated pump/spray lever 23 is operatively connected to the rock dust composition pump hydraulic motor 12 for hydraulically adjusting pumping and spraying. The manually operated mixing lever 24 is operatively connected to the mixer/agitator pump hydraulic motor 13 for hydraulically adjusting mixing/agitation. The manually operated air compressor lever 25 is operatively connected to the air compressor pump hydraulic motor for hydraulically adjusting air supply.

FIGS. 1-10 depict various schematic representations and depictions of apparatus 10. A tank 11 is mounted within the apparatus housing which comprises a removable top wall member, a sidewall member and a bottom wall member configured to form an internal tank compartment for holding and mixing a rock dust composition. A mixer (not shown) (e.g., paddle mixer) is positioned on the bottom wall member for mixing the rock dust composition. A tank discharge port is positioned on the bottom wall member or a lower portion of the sidewall member through which the rock dust composition can be discharged from the tank. A conduit extends from a tank discharge port to a housing discharge port. The conduit comprises a pump 14 (e.g., progressive cavity pump) for transporting the rock dust composition through the conduit and through a discharge line 19 (e.g., hose) operatively connected to the housing discharge port. One or more motors (e.g., rock dust composition pump hydraulic motor 12 and mixer/agitator pump hydraulic motor 13) are mounted within the housing for powering the mixer and the rock dust composition pump.

The rock dusting apparatus 10 can further comprise an air supply unit 15 mounted within the housing. The air supply unit 15 is operatively connected to the discharge line adjacent to the housing discharge port to inject air for aiding transport of the rock dust composition through the discharge line 19. The air supply unit 15 is preferably a hydraulic air compressor 15. The hydraulic air compressor 15 provides up to about 125 psi of compressed air to aid in transport of the rock dust composition through the discharge line 19. An air compressor pump hydraulic motor can be mounted within the housing for powering the air compressor. The air compressor 15 has a check valve (not shown) on a return line to the manually operated multi-spool valve bank 26 and a check valve (not shown) on a return PTO line to minimize or eliminate return line overpressure.

The rock dusting apparatus 10 can further comprise an air accumulation tank 16 mounted within the housing. The air accumulation tank 16 is operatively connected to the discharge line adjacent to the housing discharge port to inject air to aid transport of the rock dust composition through the discharge line 19.

Preferably, the rock dusting apparatus 10 of this disclosure is powered by hydraulics. The apparatus 10 operates at a hydraulic range from about 12 gpm to about 35 gpm. Preferably, the one or more motors (e.g., rock dust composition pump hydraulic motor 12 and mixer/agitator pump hydraulic motor 13) are hydraulic motors. In a preferred embodiment, the mixer is hydraulically powered by a motor 13, the rock dust composition pump is hydraulically powered by a motor 12, and the air compressor is hydraulically powered by a motor.

A motor 12 is operatively connected to the rock dusting composition pump for hydraulically powering the rock dusting composition pump. A motor 13 is operatively connected to the mixer for hydraulically powering the mixer. A motor is operatively connected to the air compressor for hydraulically powering the air compressor.

The rock dust composition pump 14 preferably is a progressive cavity pump. The pump preferably operates at a pumping cycle of from about 40 psi to about 80 psi.

Figure 5:
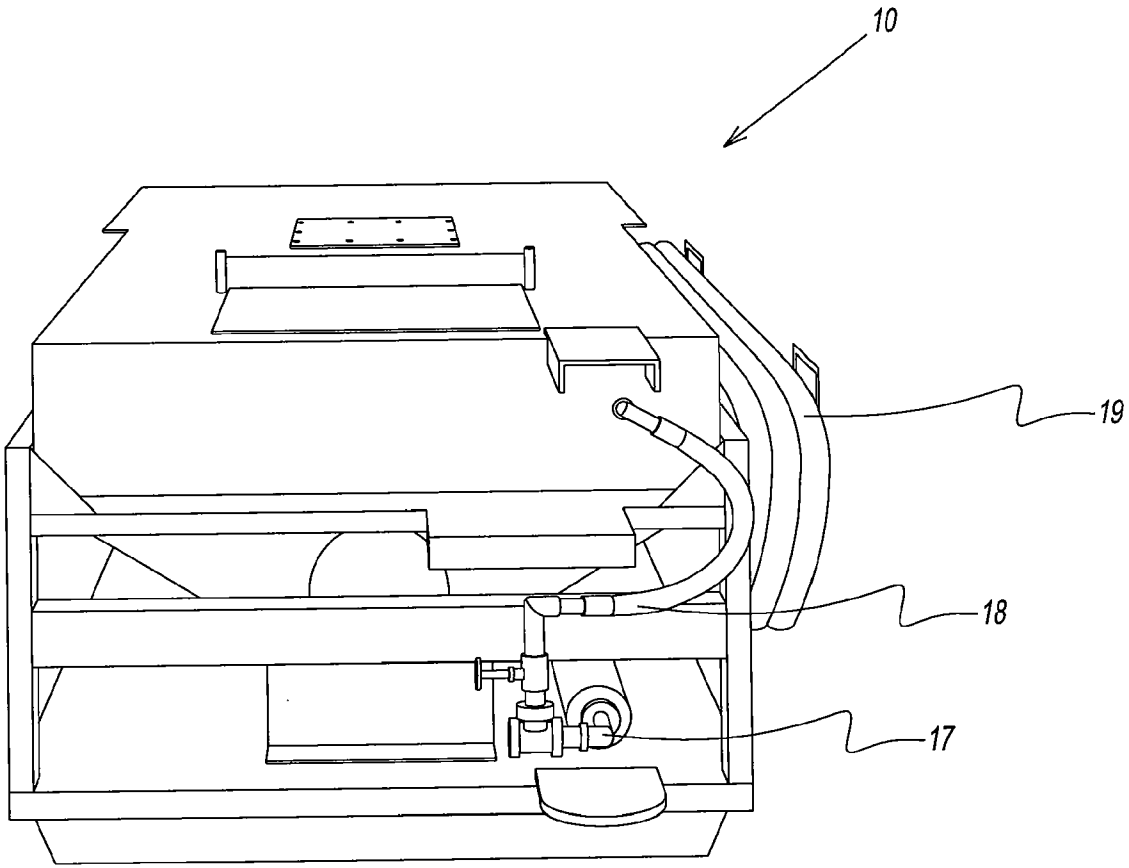
FIG. 5 depicts a front view of the rock dusting apparatus of this disclosure.
Figure 6:
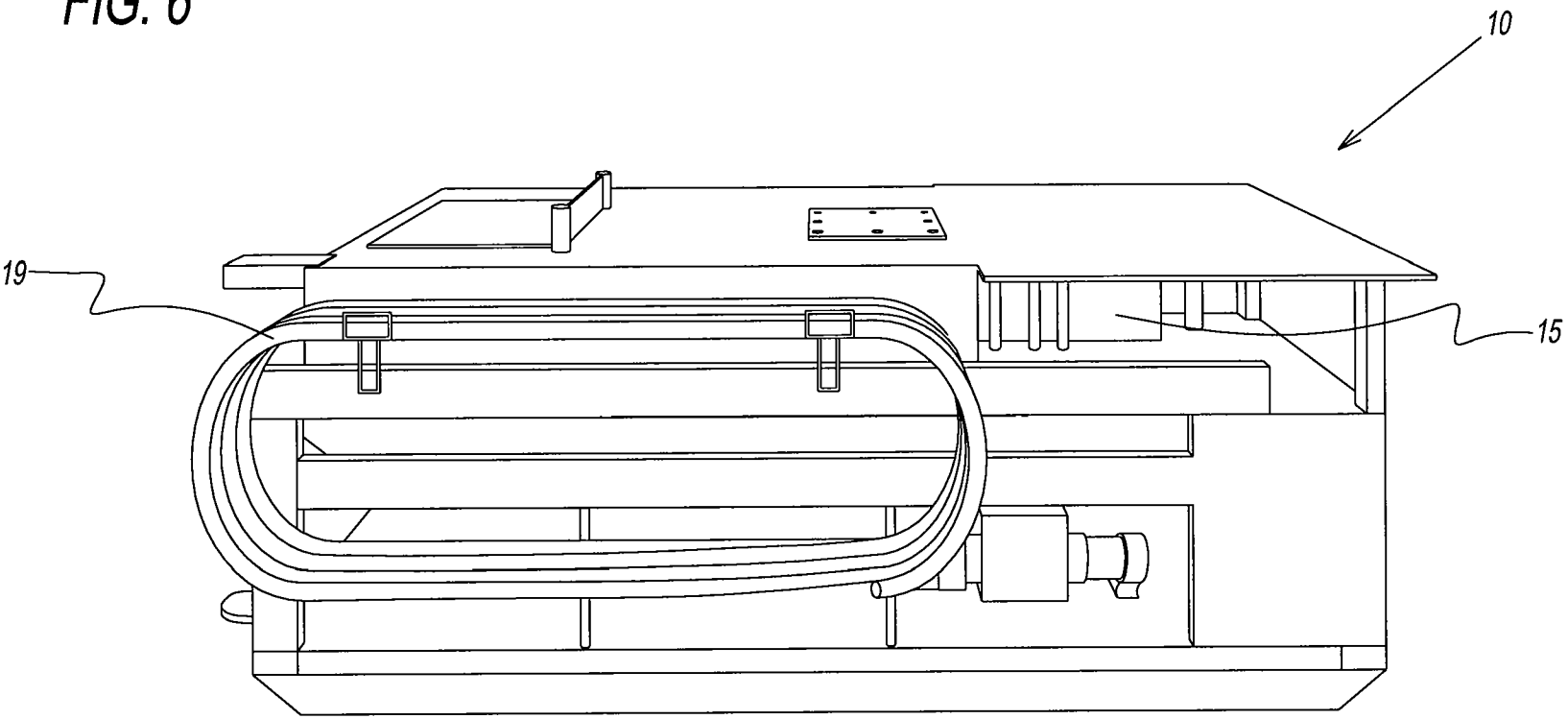
FIG. 6 depicts a right side view from the front of the rock dusting apparatus of this disclosure.
Figure 7:
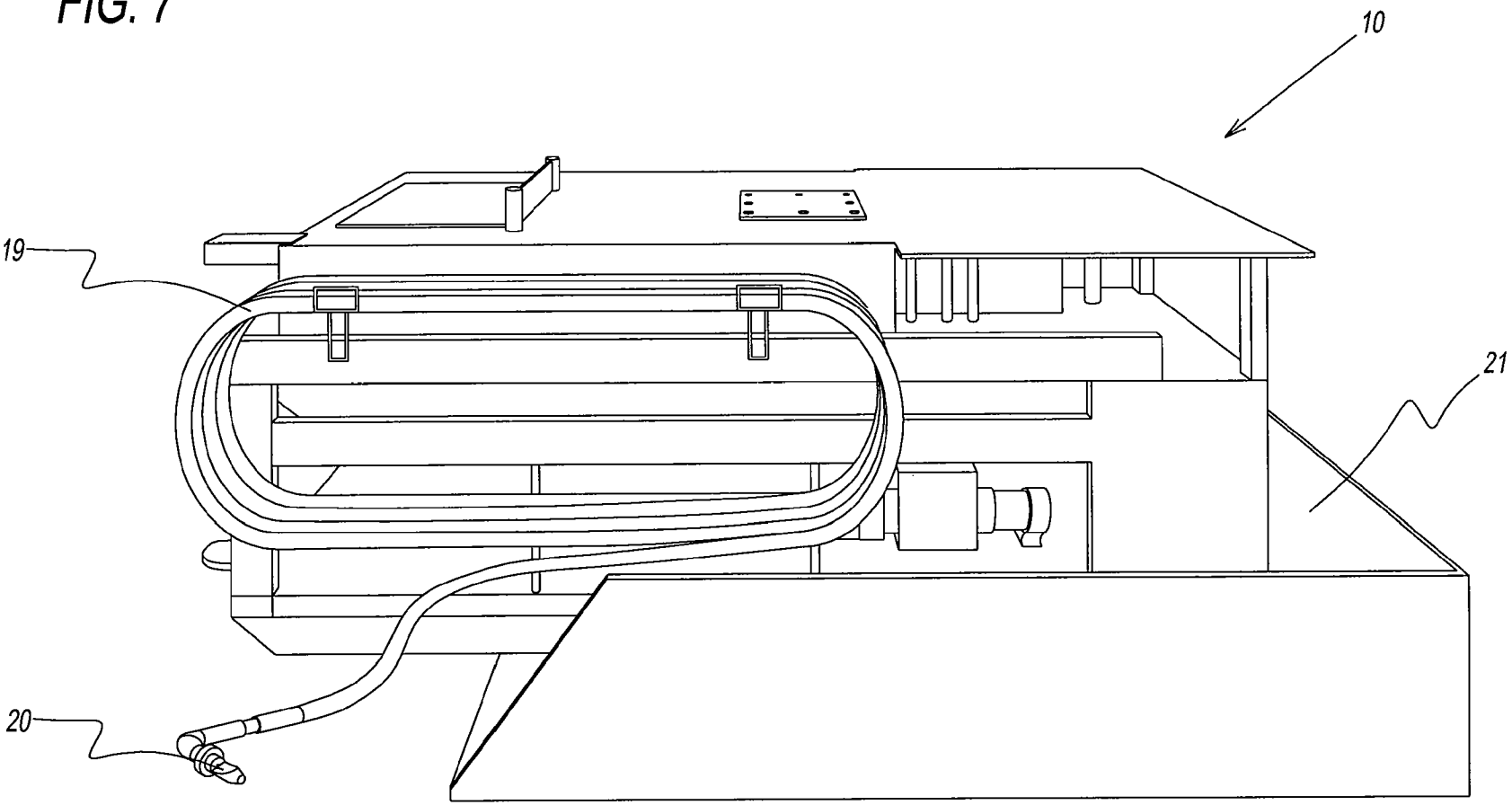
FIG. 7 depicts a right side view from the front of the rock dusting apparatus of this disclosure.
Figure 8:
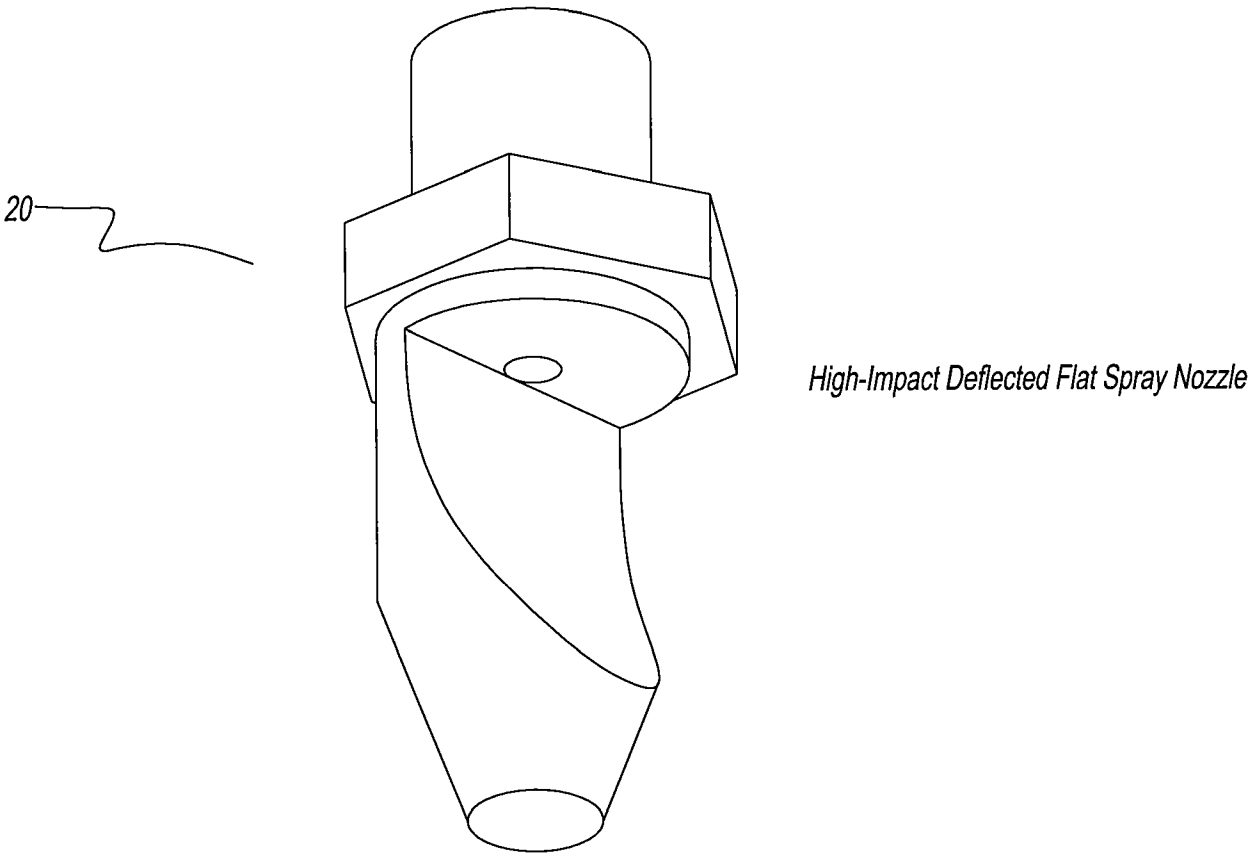
FIG. 8 depicts a high impact deflected flat spray nozzle used in the apparatus of this disclosure.
Figure 9:
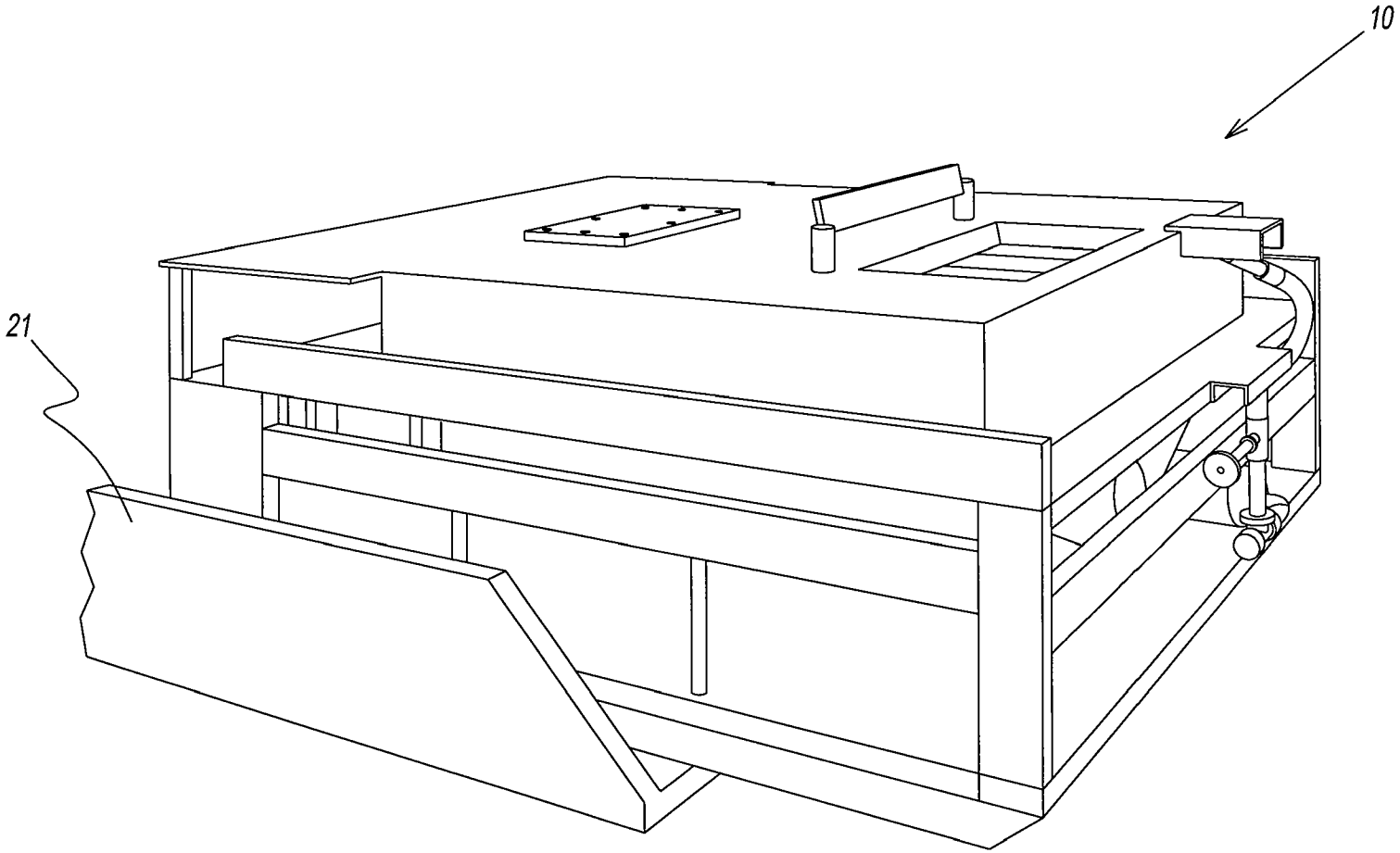
FIG. 9 depicts a left side view from the front of the rock dusting apparatus of this disclosure.

Referring to FIG. 5, the apparatus of this disclosure can include a recycle circuit 18. The recycle circuit 18 can lower operating hose 19 pressure to about 40 psi to about 80 psi. The recycle circuit 18 is operatively connected to the housing discharge port 17 to receive and recycle to the mixing tank 11 excess rock dust composition from the housing discharge port 17. The recycle circuit allows the rock dust composition in the discharge line 19 to be pumped at a pressure of from about 40 psi to about 80 psi, and compression of the rock dust composition can be controlled.

The mixer preferably performs mixing/agitation. The mixer is preferably rotatably mounted on the bottom wall member of the mixing tank 11. At the bottom of the mixing tank 11 can be a paddle mixer or segmented auger screw that provides the mixing action needed to blend the ingredients. Most preferably, the mixer comprises a paddle mixer.

The discharge line 19 preferably comprises a hose. The discharge line 19 preferably has a diameter of from about ¾ inch to about 1¼ inch. This allows lower operating pressure of the rock dusting composition pump 14, e.g., progressive cavity pump. The discharge line 19 preferably has a length from about 5 feet to about 75 feet.

The nozzle 20 is operatively connected to the discharge line 19. Preferably, the nozzle 20 comprises a high impact flat deflected nozzle.

The housing of the rock dusting apparatus 10 is adapted for carrying the tank 11, pump 14 and one or more motors (e.g., rock dust composition pump hydraulic motor 12 and mixer/agitator pump hydraulic motor 13). Preferably, the housing is adapted for carrying the tank 11, pump 14, one or more motors (e.g., rock dust composition pump hydraulic motor 12 and mixer/agitator pump hydraulic motor 13), and air supply unit 15.

The housing has a top side member, a bottom side member, generally opposite side members, and generally opposite front and rear end side members. The top side member and bottom side member are substantially parallel. The generally opposite side members are substantially parallel. The generally opposite front and rear end side members are substantially parallel.

It is understood that various combinations of valves and gauges may be used with the apparatus 10 of this disclosure. This disclosure should not be limited to the combinations of such valves and gauges and persons of ordinary skill in the art will appreciate that this disclosure includes other combinations consistent with the teachings herein.

In addition to the three spool valve bank 26 described herein, other valves, e.g., flow control valves and on/off valves, can be used in operating the apparatus 10 of this disclosure. For example, a diversion valve can be located near the three spool valve bank 26 for flow control. In batch operation with the PTO on, the diversion valve is lifted to a position near the top of the applicator lid, opening fully, and then the mixing lever 24 is pulled open on the three spool valve bank 26. At this time, the agitator in the 250 gallon tank 11 should be running at high speed, and the 250 gallon tank 11 should be vibrating.

The apparatus 10 of this disclosure can include a valve bank with gauges near the valve bank for controlling batching and spray operations. For example, an air gate valve can be included for controlling air flow, and a rock dust composition gate valve can be included for controlling flow of the rock dust composition in the batching and spraying operations. A master gate valve can be included to provide overall control of the various gate valves.

The apparatus 10 may contain one or more air flow control valves for control of flow of air to the discharge line adjacent to the housing discharge port 17. Injection of air can be controlled to aid transport of the rock dust composition through the discharge line 19. Likewise, the apparatus 10 may contain one or more rock dust composition flow control valves for control of flow of rock dust composition through the housing discharge port 17 and the discharge line 19.

The rock dusting apparatus of this disclosure is preferably portable. In operation, it is typically positioned on a scoop 21. The scoop 21 is typically attached to a mine utility tractor. The mine utility tractor typically comprises a power takeoff (PTO) that is used to provide power to apparatus 10. The mine utility tractor typically comprises a battery or diesel scoop PTO hydraulic circuit that is used to provide power to apparatus 10.

The rock dust compositions useful in the apparatus of this disclosure can include conventional compositions known in the art. A typical composition comprises rock dust, water, and a pumping aid. A preferred composition comprises rock dust, e.g., limestone dust, a polymer, e.g., acrylamide homopolymer or copolymer, a pumping aid, e.g., laurel ether sulfate, and water. Another preferred composition comprises rock dust, e.g., limestone dust, and a polymer, e.g., acrylamide homopolymer or copolymer. The compositions useful in the apparatus of this disclosure include both foamed and non-foamed, aerated and nonaerated, compositions. Preferred compositions useful in the apparatus of this disclosure are disclosed in copending U.S. patent application Ser. No. (0007238USU1), filed on an even date herewith, which is incorporated herein by reference.

In an embodiment, the operational spraying parameters of the apparatus of this disclosure utilizes the cohesive properties of water soluble polymers that allow a wet mixed rock dusting material to adhere to the mine walls in thicker layers than can be obtained with any current conventional methods. Because the rock dust is applied wet by the apparatus, particulates that go into suspension during placement are eliminated. The dusting composition will thicken and slightly gel when the anti-caking polymer is added to the dusting powder and water mixture. This will disperse the water molecules within the mass while in a wet state. As this material is allowed to dry on the mine walls, the polymer will dissipate. When the polymer dissipates, a void space is present within the rock dusting mass. This void space will vary between 3 and 50% by volume depending on the dosage and type of polymer that is used.

When subject to a mine explosion/concussion, this dusting composition will disperse as a fine powder rather than in small chunks, similar to the dispersion that will occur if the dusting composition was applied dry. The composition dried on the coal mine surface has sufficient adherence to the coal mine surface that, upon ignition of coal dust and/or gas within a coal mine, a concussion from an explosion and/or fire causes at least a portion of the rock dust particles to detach from the polymer chains to produce a rock dust-air suspension. The rock dust-air suspension suppresses propagation of a flame and/or fire caused by ignition of coal dust and/or gas within the coal mine.

In an embodiment, this disclosure involves forming a composition on a surface by a) providing a rock dusting apparatus; b) mixing rock dust and water in the rock dusting apparatus to give a first mixture; c) adding a pumping aid to the first mixture to give a second mixture; d) blending a polymer into the second mixture to give a third mixture; e) mixing with agitation the third mixture to give a foamed or aerated composition; f) applying the foamed or aerated composition to the surface using the rock dusting apparatus; and g) allowing the foamed or aerated composition to dry to form the composition on the surface. The rock dusting apparatus is as described herein.

In another embodiment, this disclosure involves forming a composition on a surface by a) providing a rock dusting apparatus; b) mixing rock dust and water in the rock dusting apparatus to give a first mixture; c) mixing a pumping aid and a polymer in a container to give a second mixture; d) adding the second mixture to the first mixture to give a third mixture; e) mixing with agitation the third mixture to give a foamed or aerated composition; f) applying the foamed or aerated composition to the surface using the rock dusting apparatus; and g) allowing the foamed or aerated composition to dry to form the composition on the surface. The rock dusting apparatus is as described herein.

In a further embodiment, this disclosure involves a method of dusting coal mine surfaces by a) providing a rock dusting apparatus; b) providing a composition comprising rock dust, water, a pumping aid, and optionally a polymer; c) mixing with agitation the composition in the rock dusting apparatus to give a foamed or aerated composition; d) applying the foamed or aerated composition to a coal mine surface using the rock dusting apparatus; and e) allowing the foamed or aerated composition to dry on the coal mine surface. The rock dusting apparatus is as described herein.

In a yet further embodiment, this disclosure involves a method for suppressing propagation of a flame and/or fire caused by ignition of coal dust and/or gas within a coal mine by a) providing a rock dusting apparatus; b) providing a composition comprising rock dust, water, a pumping aid, and a polymer; c) mixing with agitation the composition in the rock dusting apparatus to give a foamed or aerated composition; d) applying the foamed or aerated composition to a coal mine surface using the rock dusting apparatus; and e) allowing the foamed or aerated composition to dry on the coal mine surface; wherein the foamed or aerated composition dried on the coal mine surface has sufficient adherence to the coal mine surface that, upon ignition of coal dust and/or gas within the coal mine, a concussion from an explosion and/or fire causes at least a portion of the rock dust to detach from the coal mine surface to produce a rock dust-air suspension that suppresses propagation of a flame and/or fire in the coal mine. The rock dusting apparatus is as described herein.

In a preferred preparation method, a foamed slurry composition can be prepared by mixing with agitation limestone dust and water in a tank to give a slurry mixture. A paddle mixer is located at the bottom of the tank to provide the mixing with agitation. In a separate container, a pumping aid, e.g., surfactant, and a polymer are mixed to give a surfactant/polymer mixture. The surfactant/polymer mixture is added to the slurry mixture in the tank. The contents of the tank are mixed with agitation by the paddle mixer to give the foamed slurry composition. The mixing with agitation should create sufficient surface area to disperse the polymer. Additional limestone dust can optionally be added to the contents of the tank and mixed with agitation by the paddle mixer.

The foamed slurry composition includes a mixture of rock dust and polymer having a moisture content between about 26 and about 40 weight percent. The surfactant pumping aid is present in an amount that is approximately 0.1 to 0.6 weight percent concentrate by weight of foamed slurry composition. An anti-cracking copolymer is present at a dosage of 1 percent by weight of foamed slurry composition.

The foamed slurry composition is then pumped by a cavity pump from the tank to a nozzle for spraying. A mixing tee is positioned on the discharge line prior to the nozzle. The mixing tee includes a slurry supply line from the tank and an air supply line from a hydraulically powered compressor. The air supply line is used to supply air for spraying the foamed slurry composition onto a mine surface. Compressed air can be used at pressures below about 125 psi to force the foamed slurry composition out of a nozzle to create higher flow rates and sufficient velocities required for a larger spray radius. The mixing tee can be operated with our without air.

The mixing tee can be positioned at any suitable location along the discharge line. In one embodiment, the mixing tee can be positioned on the discharge line adjacent to the deflected spray nozzle. In another embodiment, the mixing tee can be positioned on the discharge line adjacent to the housing discharge port. In this embodiment, during transportation of the rock dust composition (i.e., foamed slurry composition) through the discharge line, e.g., hose, air in the discharge line with the foamed slurry composition allows for the spraying of a lighter density final product by the deflected spray nozzle which improves drying time on a mine wall. This embodiment allows for additional air penetration to the foamed slurry composition prior to spraying and creates a lighter density final product, e.g., 30 $lb/ft^3$ to 50 $lb/ft^3$. Also, this embodiment eliminates the foamed slurry composition traveling the length, e.g., 50 feet, of the discharge line to the deflected spray nozzle without air, and simplifies the discharge line to have only one shut off valve for simpler operation. More shut off valves, e.g., 3 or more, are needed when the mixing tee is nearer to the deflected spray nozzle.

The foamed slurry composition is then sprayed onto a mine surface. The spraying allows the foamed slurry composition to adhere to the surfaces of the mine, enabling application of multiple layers until a desired thickness is achieved. Each layer typically has a thickness of less than about 1/32 of an inch. The foamed slurry composition has a density of greater than about 60 pounds per cubic foot.

An embodiment of this disclosure includes a method for spraying a mine surface with a composition comprising rock dust, e.g., the dust of limestone, dolomite, magnesite, Class F fly ash, silica fume, gypsum, anhydrite, non-expansive clays, fine ground mine tailings, and mixtures thereof; water; a pumping aid, e.g., laurel ether sulfate; and a polymer, e.g., acrylamide homopolymer or copolymer. The method involves conveying the composition to a spray nozzle which can be accomplished by pumping or by pneumatic conveyance, and spraying the composition onto the mine surface. The composition adheres to the mine surface of the mine and dehydrates or loses moisture to form a porous coating, e.g., a coating having void spaces. When referring to a mine throughout this disclosure, it is also meant to include a stope.

A preferred method for dusting coal mine surfaces involves selecting the appropriate mixing vessel; adding the dry rock dust powder and water to the vessel; at the discharge of the mixing vessel, adding a tee to inject the pumping aid and anti-caking copolymer prior to the pump hose; and spraying the material on the mine walls.

A preferred method for applying the composition to coal mine surfaces comprises selecting a mixing vessel that has paddle mixers within the confinements. The size of the mixing vessel is preferably at least 13 cubic feet. The mixer should having sufficient mixing speed that can thoroughly mix the rock dust and water. At the discharge of the mixing vessel is a pump, either a progressive cavity or piston type that can pump at pressures of at least about 50 psi. The output of the pump should be a minimum of 3 gallons per minute. At the discharge of the pump, a tee is added to inject the pumping aid surfactant with anti caking polymer. The pumping aid and anti caking polymer are added to a steel pressurized tank. This tank is then pressurized with air to between about 100 to 200 psi. The pressurized surfactant pumping aid with anti caking polymer are then injected into the pump hose and the resulting composition sprayed onto the mine walls. The spray nozzle will consist of a restriction in the spray stream that will create velocity and pressure. This velocity and pressure will allow the product to be sprayed on the mine walls.

As indicated above, the most common method of applying rock dust is dry. This is because the rock dust will be non-cohesive when applied. In the event of a methane explosion, the rock dust will disperse as a powder. Lumping will not occur because there is no water used which causes the rock dust to be cohesive. In a wet spray application, the rock dust becomes a solid cohesive mass when allowed to dry. Thus in the event of a methane explosion, the rock dust will disperse in lumps and chunks. The rock dust will not have the fineness (surface area) to be effective in a mine explosion The present disclosure allows the rock dust to lift off as a powder when applied wet (about 300 microns or less), making the rock dust effective in a methane explosion. The material of this disclosure will disperse similar to the dry dust method.

The method of wet spraying rock dust is typically not used in the art for a variety of reasons. The method takes too long for the wet rock dust to dry on the mine walls. When the wet rock dust dries, it is too cohesive to lift off the mine walls in the event of a methane explosion. If the rock dust does lift off, it will be in chunks rather than in a fine powder.

The apparatus of this disclosure allows the rock dust composition to be sprayed at a water content of about 25% less than conventional wet methods. This is primarily due to the use of a pumping aid. The pumping aid is typically a surfactant or air that moves the slurry dust through the hose. The rock dust composition will dry typically within 24 hours after being applied to a surface. The polymer will allow the material to be cohesive when applied in a wet state, but non-cohesive when allowed to dry. This will allow the material to disperse as a powder rather than in chunks if a methane explosion were to occur.

The apparatus of this disclosure allows rock dusting compositions to be deposited on the coal mine surface at a desired thickness. For example, coatings formed on the coal mine surfaces can range in thickness from about 0.25 to about 2.5 cm, preferably from about 0.5 to about 2 cm, and more preferably from about 1.5 to about 1.8 cm. An advantage of applying the rock dust utilizing a wet composition is that when the wet composition is delivered such as by using a spray device, it allows the wet composition to adhere to the surfaces of the mine, enabling application of multiple layers until a desired thickness is achieved. Additionally, no excessive dust is produced during the application, thereby potentially eliminating the need to evacuate the mines during the process.

The apparatus of this disclosure allows the rock dusting compositions to be pumped and sprayed against mine wall surfaces, e.g., walls, ceilings and floors. The composition can be applied with the inventive apparatus that allows the composition to adhere to the coal mine surfaces. Because the composition is applied wet, it can be built up to any thickness suitable for the particular application. The composition has a water content and a polymer content sufficient to allow the polymer (i) to disperse water molecules within the composition and, upon drying of the composition, (ii) to dissipate forming void spaces in the dried composition.

Various modifications and variations of this disclosure will be obvious to a worker skilled in the art and it is to be understood that such modifications and variations are to be included within the purview of this application and the spirit and scope of the claims.

EXAMPLES

Operational Batching Procedures

The first step is to look into the mixing tank, e.g., 250 gallon batching tank, and check for it being clean. Then taking a clean out hose with a reducer for high pressure spray 150 psi or greater, clean the floor of the 250 gallon batching tank of any dry residue, and fill the tank to the desired gallons of water depending upon the mixture level utilized.

Next have the applicator in the scoop bucket with the hydraulic PTO connected. Have the PTO on, and pull the applicator lever for the air compressor to check to see that the air compressor that is on board the applicator is running and building pressure on the gauges near the valve bank. This assures that the PTO is properly hooked up. Then return the air compressor lever to the off position.

To the left of the three spool valve bank is located a diversion valve. With the PTO on, the next step is to lift the diversion valve to a position near the top of the applicator lid, opening fully, and then pull open the mixing lever on the three spool valve bank. At this time, the agitator in the 250 gallon tank should be running at high speed, and the 250 gallon tank should be vibrating.

With the agitator running at high speed, and water at the desired level, begin to place the desired amount of rock dust into the 250 gallon batching tank. Let the agitator pull into slurry each 50 pound amount of rock dust before starting to empty the next bag. Never put hands in tank area while applicator is powered.

Once all of the rock dust bags of limestone are slurrified in the 250 gallon tank into wet dust, then pour in the appropriate amount of polymer/surfactant concentrate. The slurrified wet dust and polymer/surfactant concentrate should then begin to build into a foam slurry composition. Agitate this mixture for approximately 1 to 2 minutes at most.

Application of the foamed rock dust composition is then ready to begin.

Spray Operation Procedures

With the batch of rock dust composition ready to go in the tank, tram the scoop up to the desired location to begin spraying operations. Stretch out the hose, e.g., 50 foot air hose, and visually check for kinks or cuts on the hose lines. Visually look over the tee mixing area, and shut off the air gate valve, rock dust composition gate valve, and master gate valve.

At this time, push the diversion valve down (near the three spool valve bank) in the 50%/50% location, and pull on the pump lever and the air compressor lever. The mixing lever should remain in the off position.

Turn on the air line gate valve at the end of the hose to check that the line is clear, the flat deflected spray nozzle is clear, and that the compressor is building pressure.

Next look into the 250 gallon batch tank, and look at the recycle outlet and minimize the backflow of the recycle of the rock dust composition returning to the tank.

Spraying operations are now ready to begin. At the nozzle end, open the master gate valve, and the rock dust composition gate valve, and wait for the foamed rock dust composition material to be pumped at the end of the deflected spray nozzle.

When the foamed rock dust composition is received at the nozzle, begin to open the air gate valve to allow for proper dispersion of the foamed rock dust composition to the mine roof and ribs. Continue to cover the work area roof and ribs with the desired amount of foamed rock dust composition per the specific application.

When the tank is emptied, shut off the pump lever and the air compressor lever. Return to the water station and begin the batching procedure once again.

Troubleshooting

No Compressed Air—A piece of a limestone rock dust bag or other materials could be stuck inside the nozzle of the deflected spray nozzle. Shut off all of the nozzle gate valves, and remove the deflected nozzle and then remove the blockage materials, flush the lines, and put the deflected spray nozzle back into position and return to operations. Air pressures higher than 80 psi at the gauge would be an indication of blockage.

Batch Too Foamy—Will not Pump—Batch of rock dust composition is not properly mixed, and the pump is cavitating because of too much foam material. Take clean out hose and add water content and additional bags of rock dust 3 to 5 bags, and re-agitate materials to develop a properly mixed batch in alignment within the mixing guidelines.

Batch Materials Not Properly Mixed—Make sure diversion valve is wide open to allow for maximum hydraulic flow to the mixer (agitation) circuit. Limestone material should be fully slurrified into batch before the polymer/surfactant concentrate is added.

Not Building Compressed Air—PTO lever needs to be pulled in the opposite direction. Air compressor hydraulics require proper PTO line hook up. With lines switched, diversion valve at 50%/50%, pull open air compressor lever, check gauges, compressor should now run. This issue has been resolved or eliminated by two in line hydraulic check valves being placed on the return lines of the PTO, and air compressor line.

While we have shown and described several embodiments in accordance with our disclosure, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. A rock dusting apparatus comprising:

a housing;

a tank mounted within said housing which comprises a removable top wall member, a sidewall member and a bottom wall member configured to form an internal tank compartment for holding and mixing a rock dust composition;

a mixer positioned on the bottom wall member for mixing the rock dust composition;

a tank discharge port positioned on the bottom wall member or a lower portion of said sidewall member through which the rock dust composition can be discharged from said tank;

a conduit extending from said tank discharge port to a housing discharge port; said conduit comprising a pump for transporting the rock dust composition through the conduit and through a discharge line operatively connected to said housing discharge port;

one or more motors mounted within said housing for powering said mixer and said pump;

an air supply unit mounted within said housing that is operatively connected to the discharge line adjacent to the housing discharge port to inject air for aiding transport of the rock dust composition through the discharge line; and a recycle circuit operatively connected to said housing discharge port to receive and recycle to the mixing tank excess rock dust composition from said housing discharge port, so that the rock dust composition in said discharge line can be pumped at a pressure of from about 40 psi to about 80 psi, and compression of the rock dust composition can be controlled.

2. The rock dusting apparatus of claim 1 wherein said air supply unit comprises a hydraulic air compressor.

3. The rock dusting apparatus of claim 1 wherein said one or more motors comprise hydraulic motors.

4. The rock dusting apparatus of claim 1 wherein said mixer is hydraulically powered by a motor, said pump is hydraulically powered by a motor, and said air supply unit is hydraulically powered by a motor.

5. The rock dusting apparatus of claim 1 wherein said pump comprises a progressive cavity pump.

6. The rock dusting apparatus of claim 1 wherein said pump operates at a pumping cycle of from about 40 psi to about 80 psi.

7. The rock dusting apparatus of claim 1 that is powered by hydraulics.

8. The rock dusting apparatus of claim 1 that operates at a hydraulic range from about 12 gpm to about 35 gpm.

9. The rock dusting apparatus of claim 1 further comprising a recycle circuit.

10. The rock dusting apparatus of claim 1 wherein the mixer comprises a mixer/agitator.

11. The rock dusting apparatus of claim 1 wherein the mixer comprises a paddle mixer.

12. The rock dusting apparatus of claim 1 wherein the discharge line comprises a hose having a diameter of from about ¾ inch to about 1¼ inch, and a length from about 5 feet to about 75 feet.

13. The rock dusting apparatus of claim 1 further comprising a nozzle operatively connected to said discharge line.

14. The rock dusting apparatus of claim 1 wherein the nozzle comprises a high impact flat deflected nozzle.

15. The rock dusting apparatus of claim 1 further comprising an air accumulation tank mounted within said housing, said air accumulation tank operatively connected to the discharge line adjacent to the housing discharge port to inject air to aid transport of the rock dust composition through the discharge line.

16. The rock dusting apparatus of claim 1 that is portable.

17. The rock dusting apparatus of claim 1 positioned on a scoop.

* * * * *